US008758601B2

(12) United States Patent
Ophus

(10) Patent No.: US 8,758,601 B2
(45) Date of Patent: Jun. 24, 2014

(54) REMOVAL OF HYDROCARBONS FROM PARTICULATE SOLIDS

(71) Applicant: Kevin Ophus, Bezanson (CA)

(72) Inventor: Kevin Ophus, Bezanson (CA)

(73) Assignee: US Oil Sands Inc., Calgary, Alberta (CA)

( * ) Notice: Subject to any disclaimer, the term of this patent is extended or adjusted under 35 U.S.C. 154(b) by 0 days.

(21) Appl. No.: 13/622,061

(22) Filed: Sep. 18, 2012

(65) Prior Publication Data

US 2013/0062258 A1 Mar. 14, 2013

Related U.S. Application Data

(63) Continuation-in-part of application No. 11/574,530, filed as application No. PCT/CA2004/001826 on Oct. 15, 2004, now abandoned.

(51) Int. Cl.

| | |
|---|---|
| ***C10G 1/04*** | (2006.01) |
| ***C10G 21/14*** | (2006.01) |
| ***C10G 21/28*** | (2006.01) |

(52) U.S. Cl.

USPC ..... 208/390; 208/321; 208/324; 208/337

(58) Field of Classification Search

USPC ..... 208/311, 321, 324, 325, 337, 390

See application file for complete search history.

(56) References Cited

U.S. PATENT DOCUMENTS

| | | | |
|---|---|---|---|
| 4,722,782 | A | 2/1988 | Graham et al. |
| 4,822,481 | A | 4/1989 | Taylor |
| 4,946,597 | A | 8/1990 | Sury |
| 4,966,685 | A | 10/1990 | Hall et al. |
| 5,143,598 | A | 9/1992 | Graham et al. |
| 5,169,518 | A | 12/1992 | Klimpel et al. |
| 5,316,664 | A | 5/1994 | Gregoli et al. |
| 5,338,368 | A | 8/1994 | Fletcher et al. |
| 5,340,467 | A | 8/1994 | Gregoli et al. |
| 5,453,133 | A | 9/1995 | Sparks et al. |
| 5,534,136 | A | 7/1996 | Rosenbloom |
| 5,634,984 | A | 6/1997 | Van Slyke |
| 5,645,714 | A | 7/1997 | Strand et al. |
| 5,681,452 | A | 10/1997 | Kirkbride |
| 5,690,811 | A | 11/1997 | Davis et al. |
| 5,723,042 | A | 3/1998 | Strand et al. |
| 5,723,423 | A | 3/1998 | Van Slyke |
| 5,746,909 | A | 5/1998 | Calta |
| 5,780,407 | A | 7/1998 | Van Slyke |
| 5,788,781 | A | 8/1998 | Van Slyke |
| 5,985,138 | A | 11/1999 | Humphreys |
| 6,004,455 | A | 12/1999 | Rendall |
| 6,007,708 | A | 12/1999 | Allcock et al. |
| 6,007,709 | A | 12/1999 | Duyvesteyn et al. |
| 6,074,549 | A | 6/2000 | Bacon Cochrane et al. |
| 6,093,689 | A | 7/2000 | Vlasblom |
| 6,110,359 | A | 8/2000 | Davis et al. |
| 6,153,017 | A | 11/2000 | Ward et al. |
| 6,207,044 | B1 | 3/2001 | Brimhall |
| 6,211,133 | B1 | 4/2001 | Chesky |
| 6,214,213 | B1 | 4/2001 | Tipman et al. |
| 6,319,395 | B1 | 11/2001 | Kirkbride et al. |
| 6,358,403 | B1 | 3/2002 | Brown et al. |
| 6,358,404 | B1 | 3/2002 | Brown et al. |
| 6,527,960 | B1 | 3/2003 | Bacon et al. |
| 6,576,145 | B2 | 6/2003 | Conaway et al. |
| 6,709,573 | B2 | 3/2004 | Smith |
| 2003/0213747 | A1 | 11/2003 | Carbonell et al. |

FOREIGN PATENT DOCUMENTS

| | | |
|---|---|---|
| CA | 2179720 | 6/1995 |
| WO | 0022067 | 4/2000 |
| WO | 0139904 | 6/2001 |

*Primary Examiner* — Renee E Robinson

(74) *Attorney, Agent, or Firm* — Bennett Jones LLP

(57) ABSTRACT

A process and composition for removing heavy oil and bitumen from oil sands is disclosed. The composition comprises an emulsion of d-limonene in water, with an optional anionic surfactant as an emulsifying agent. The emulsion is contacted with an oil sand slurry until the aqueous and hydrocarbon phases separate. The process may take place at temperatures less than about 80° C. and with low concentrations of the d-limonene.

9 Claims, 8 Drawing Sheets

REMOVAL OF HYDROCARBONS FROM PARTICULATE SOLIDS

CROSS REFERENCE TO RELATED APPLICATIONS

This application is a continuation-in-part application of U.S. patent application Ser. No. 11/574,530 filed on Oct. 15, 2004 entitled "Removal of Hydrocarbons From Particulate Solids", the entire contents of which are incorporated herein by reference.

FIELD OF THE INVENTION

The present invention relates to a composition and a process for removing hydrocarbons from solid particulate matter. In particular, the present invention relates to a composition and process for separating heavy oil or bitumen from sand. The present invention also relates to a plant where the process may be implemented and the light oil product which is recovered.

BACKGROUND OF THE INVENTION

Considerable oil reserves around the world are locked in the form of oil sands, also called tar or bitumen sands. Particularly large deposits are known to exist in the Athabasca and Cold Lake regions of Alberta and smaller deposits are found in many areas in the United States including Utah. Oil sands are typically surface mined and the contained bitumen is separated from the sand and recovered using what is commonly referred to as the Clark hot water extraction process. The hot water extraction process is the standard process for recovering bitumen from the sand and other material in which it is bound. The bitumen is then upgraded to obtain a synthetic crude oil.

In the hot water extraction process using existing extraction facilities, tar sand is first conditioned in large conditioning drums or tumblers with the addition of caustic soda (sodium hydroxide) and hot water at a temperature of about 80° Celsius. The nature of these tumblers is well known in the art. The tumblers have means for steam injection and further have retarders, lifters and advancers which create violently turbulent flow and positive physical action to break tip the tar sand and mix the resultant mixture vigorously to condition the tar sands. This causes the bitumen to be aerated and separated to form a froth.

The mixture from the tumblers is screened to separate the larger debris and is passed to a separating cell where settling time is provided to allow the aerated slurry to separate. As the mixture settles, the bitumen froth rises to the surface and the sand particles and sediments fall to the bottom to form a sediment layer. A middle viscous sludge layer, termed middlings, contains dispersed clay particles and some trapped bitumen which is not able to rise due to the viscosity of the sludge. The froth is skimmed off for froth treatment and the sediment layer is passed to a tailings pond. The middlings is often fed to a second stage of froth floatation for further bitumen froth recovery. The water/clay residue from this second stage is combined with the sediment layer from the separating cell for disposal in the tailing ponds.

This conventional hot water technique is energy intensive in part because of the elevated temperature of the initial hot water. Additionally, the process produces an environmental issue in the form of the tailings byproduct which comprises a mixture of water, sand, silt and fine clay particles. Fast-settling sand particles are used to construct mounds, dikes and other stable deposits. However, the leftover muddy liquid, consisting of slow-settling clay particles and water, are the fine tailings and are difficult to dispose of. Fine tailings take a very long time to settle and are produced in significant volumes. Therefore, tailings management is a significant issue that must be addressed by any plant using a hot water bitumen separation process.

Therefore, there is a need in the art for compositions and methods for separating and recovering bitumen from particulate solids which may mitigate the difficulties of the prior art.

SUMMARY OF THE INVENTION

In one aspect, the invention may comprise a composition for use in the primary separation of heavy oil or bitumen from oil sands, comprising an emulsion of an organic phase comprising d-limonene in an aqueous phase. In one embodiment, the organic phase consists essentially of d-limonene.

In another aspect, the invention may comprise a plant for processing feedstock comprising oil sand or contaminated soil to separate hydrocarbons from solid particles, comprising:

(a) a feed hopper for feeding feedstock into a mixing vessel;
(b) the mixing vessel having an inlet for adding a cleaning emulsion as described or claimed herein to the mixing vessel to form a slurry;
(c) means for agitating the slurry until the emulsion breaks;
(d) an oil skimmer for recovering hydrocarbons;
(e) means for recovering the solids, substantially free of hydrocarbons.

The plant preferably comprises at least one recovery tower for receiving the slurry from the mixing vessel and which comprises the oil skimmer. The plant may further comprise means for recovering the aqueous phase and recycling the aqueous phase into the mixing vessel.

In another aspect, the invention may comprise a oil product produced as a result of the processes described herein. In one embodiment, the oil product comprises a mixture of a monocyclic terpene such as d-limonene and a heavy oil or bitumen, substantially free of water and particulate solids. Preferably, the light oil product has an API density of at least about 22° C.

In another aspect, the invention may comprise a process for primary extraction of bitumen from oil-wet or water-wet oil sands, comprising the step of mixing an effective amount of the composition described herein with an aqueous slurry of the oil sands, and recovering a hydrocarbon phase.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF THE INVENTION

Figure 1:
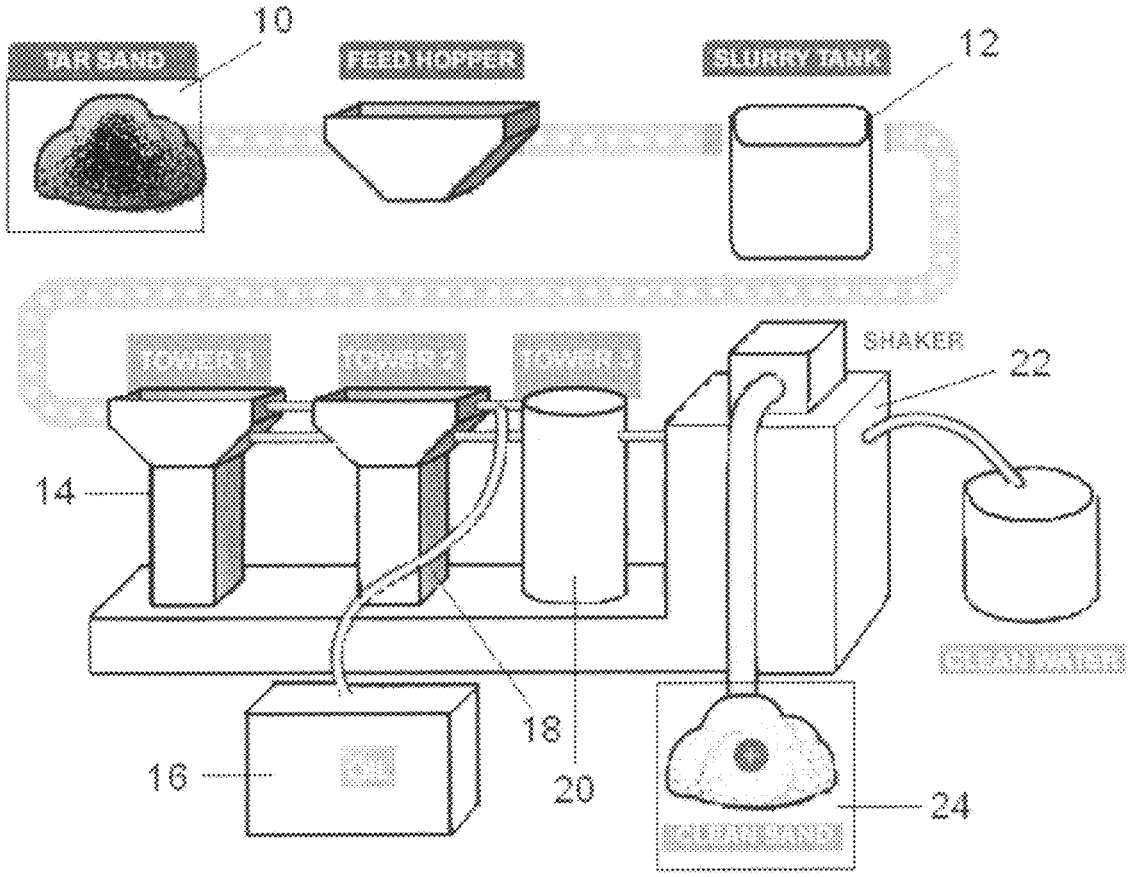
FIG. 1 is a schematic representation of one embodiment of the present invention.

The present invention provides for a process and composition for separating heavy oil and bitumen from solid particulate matter. Additionally, a plant for implementing the process as well as the recovered oil product are described. When describing the present invention, all terms not defined herein have their common art-recognized meanings.

The present invention is described herein with reference to cleaning heavy oil or bitumen from oil sands or tar sands. The invention may equally be applicable to removing hydrocarbons from any solid particulate matter and may be useful, for example, in cleaning oil-contaminated soil.

As used herein, an "emulsion" refers to a mixture of two liquids, where droplets of a first liquid are dispersed in a second liquid where it does not dissolve. The particles or droplets may be on a micron scale, or smaller. The dispersed liquid is said to form the disperse phase, while the other liquid is said to form the continuous phase.

Oil ranges in density and viscosity. Light oil, also called conventional oil, has an API gravity of at least 22° and a viscosity less than 100 centipoise (cP). Heavy oil is an asphaltic, dense (low API gravity), and viscous oil that is chemically characterized by its content of asphaltenes. Although variously defined, the upper limit for heavy oil is generally considered to be about 22° API gravity and a viscosity of greater than 100 cP. Heavy oil includes bitumen, also called tar sands or oil sands, which is yet more dense and viscous. Natural bitumen is oil having a viscosity greater than 10,000 cP, Viscosity is a measure of the fluid's resistance to flow and is expressed in centipoise units. The viscosity of water is 0.89 centipoise and the viscosity of other liquids is calculated by applying the follow formula:

$$Vs=Ds(fts)(Vw)/(Dw)(ftw)$$

Where:

Vs=viscosity of sample

Ds=density of sample fts=flow time for sample

Vw=viscosity of water=0.89 centipoise (25° C.)

Dw=density of water=1 g/mL ftw=flow time for water.

Density is a measure of mass per unit volume and is an indicator of yield from distillation. Oil density may be expressed in degrees of API gravity, a standard of the American Petroleum Institute. API gravity is computed as (141.5/spg)−131.5, where spg is the specific gravity of the oil at 60° F. API gravity is inversely related to density.

The present invention comprises a cleaning emulsion which removes the heavy oil or bitumen from the sand particles and allows it to substantially separate from the water phase. In one embodiment, the composition comprises a mixture of an aqueous phase and an organic phase comprising a terpene, which is preferably a monocyclic terpene such as d-limonene. In one embodiment, the composition may comprise an effective amount of an emulsifying agent. The emulsifying agent may preferably be an oil-soluble surfactant. Preferred surfactants include anionic surfactants, including sulfonates, and alkylaryl sulfonates in particular. In one specific embodiment, the surfactant is an alkyl aryl sulfonate marketed by Akzo Nobel Surface Chemistry as Witconate P.1059™ (isopropylamine dodecylbenzenesulfonate).

As used herein, a "terpene" is an unsaturated hydrocarbon obtained from plants. Terpenes include $C_{10}$ and $C_{15}$ volatile organic compounds derived from plants. Terpenes are empirically regarded as built up from isoprene, a $C_5H_8$ diene, and are generally associated with characteristic fragrances. Some terpenes are alcohols such as menthol from peppermint oil, and some terpenes are aldehydes such as citronellal. Limonene commonly refers to a monocyclic compound having the formula $C_{10}H_{16}$ and the structural formula:

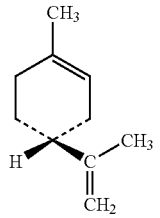

This compound's IUPAC name is (R)-4-isoprenyl-1-methylcyclohexene or p-mentha-1,8-diene. The structure shown above is of d-limonene which has a pleasing citrus odor. Its enantiomer 1-limonene has a harsher odor more reminiscent of turpentine. The preferred compound for the present invention comprises d-limonene of Brazilian origin. D-limonene is also commonly sourced from Californian or Floridian origin.

In a preferred embodiment, the emulsion further comprises a defoaming agent to assist in the mixing process. A suitable anti-foaming agent is available from Guardex PC-O-H 4625.

In a preferred embodiment, the cleaning emulsion is prepared by adding an aqueous component to the organic phase, which preferably consists of d-limonene, plus an optional emulsifying agent and an optional anti-foaming agent, resulting in a relatively stable emulsion. In a preferred embodiment, the emulsion is an oil-in-water emulsion. The organic phase does not include another solvent or co-solvent.

The aqueous portion of the composition may be purified, deionized or distilled water, or various other aqueous solutions including those commonly referred to as hard water, chlorine water, or soda water. Hard water comprises water high in dissolved minerals, primarily calcium and magnesium. Chlorine water is a mixture of chlorine and water, where only a part of the chlorine introduced actually goes into solution, the major part reacting chemically with the water to form hydrochloric acid and hypochlorous acid. Soda water comprises a weak solution of sodium bicarbonate. The inventor has found that different aqueous forms may be more suitable than others in specific applications. A person skilled in the art will be able to test and choose an appropriate aqueous component with minimal experimentation. In a preferred embodiment for cleaning oil sands, soda water has been found to be suitable.

In one embodiment, a batch of the emulsion is prepared with about 40% (v:v) d-limonene, about 0.2% alkyl aryl sulfonate, and about 60% soda water. The water is added to the d-limonene and oil-soluble emulsifying agent with vigorous mixing, resulting in a slightly thickened emulsion, which resembles cow's cream in consistency and colour. In the applicant's experience, the emulsion is sufficiently mixed when a steel shaft is dipped into the emulsion and a visible film is left on the shaft. In one embodiment, the mixture may be mixed for about 24 to 48 hours. The proportion of d-limonene in the emulsion may be varied, for example, from about 10% to about 50% by volume.

In use, the cleaning composition is used by combining it with the oil sand in an aqueous slurry with agitation. The mixture then separates into oil and water phases, with the solids settling out with the water phase. Without being restricted to a theory, it is believed that the disperse phase of d-limonene in the emulsion contacts the sand or soil particles and coalesces with the hydrocarbons bound to the particles. The emulsion in the cleaning composition breaks as a result and the two phases separate. During this process, the heavy oil and water associated with the sand or soil particles also separate, with the heavy oil dissolving in the d-limonene.

In one embodiment, the cleaning composition is used in a process to extract bitumen from oil sands, such as the Athabasca oil sands found in northeastern Alberta, Canada, or the Utah oil sands, found in Utah, United States. Athabasca oil sands are typically water-wet oil sands, where a layer of water surrounds each sand grain. Utah oil sands are typically oil-wet oil sands, where the oil clings to the sand particles without an intermediate layer of water, The Clark hot water process has been found to be effective with water-wet oil sands but not oil-wet oil sands.

Conventionally, primary separation of bitumen is performed by hot caustic water air flotation, producing a bitumen froth. Solvents may then be used in secondary and tertiary bitumen separation. In an embodiment of the present invention, the cleaning composition is used in a primary separation of bitumen from oil sands, which have been treated crush-treated only to facilitate mixing with the cleaning composition.

FIG. 1 illustrates a schematic of a plant designed to implement the cleaning process of the present invention. The oil sand is processed into a small crush (10), preferably about a ¾" crush, with a crusher or other suitable means and mixed with water to form a slurry in a slurry tank (12). An effective amount of the cleaning composition is then added and the slurry is vigorously agitated using conventional mixers or mixing pumps (not shown). The agitation is not so vigorous as to create any significant froth, but will be sufficient to allow significant recovery of the bitumen. The slurry is then sent to a first recovery tower (14) where the phases begin to separate, with the hydrocarbons rising to the surface. The hydrocarbons are skimmed from the surface and removed to an oil storage tank (16). The aqueous and solids phases may then be sent to a second recovery tower (18), where further agitation continues the cleaning process. The concentration of the cleaning emulsion may be topped up with the addition of fresh emulsion at this stage. Again, hydrocarbons are recovered from the top of the tower and sent to the oil storage tank. The aqueous phase and solids, substantially free of hydrocarbons, are then sent to a third tower (20) where the aqueous phase is recovered and disposed of, or recycled in the process. A solids separation unit (22), such as a shaker or a hydrocyclone, may then be used to collect and dry the sand (24).

The cleaning emulsion may also be used in a batch process, as will be appreciated by those skilled in the art.

The process of the present invention has 2 main variables which affect the efficiency of the operation: the concentration of the d-limonene and the temperature of the process. Generally, the higher the temperature and the higher the d-limonene concentration, the better results may be obtained. Therefore, in one embodiment, the process includes use of the cleaning emulsion in a concentration greater than about 4% by volume and at temperatures greater than about 20° C. More preferably, the solvent may be used in a concentration greater than about 6%, and most preferably greater than about 8%. Preferably, the process is operated at a temperature greater than about 30° C. and most preferably greater than about 40° C.

The recovered oil product becomes diluted with the d-limonene as a result of the cleaning process and is therefore less viscous and lighter than heavy oil. The actual viscosity and density of the end product is dependent on the feedstock used and the concentration of d-limonene used in the process. In one embodiment, the recovered oil product has an API density of at least about 22°, and more preferably greater than about 24°.

In one embodiment, the d-limonene is recovered immediately after primary bitumen separation, and recycled into the process. D-limonene has a boiling point of about 178° C. and may be separated from the recovered oil product by distillation or a similar process.

In conventional oil sands operations, high mechanical energy is used in the primary bitumen separation frothing step, resulting in stabilized suspensions of clays and other fine particles. Because embodiments of the claimed invention do not impart such high energy in agitating the primary separation mixture, and facilitate separation of clay and other fine particles, the production of stabilized suspensions of clay and other fine particles is significantly reduced. Thus, the need for extensive tailings treatment is also reduced.

EXAMPLES

The following examples are intended to illustrate embodiments of the claimed invention and not to limit the claimed invention in any manner.

1. Formation of the Cleaning Emulsion

A cleaning emulsion of the present invention was formed from 410 liters of d-limonene mixed with 2 liters of Witconate P-1059™ (Akzo Nobel Surface Chemistry) and about 20 ml of an anti-foaming agent. Approximately 600 liters of water was then added and the mixture agitated between about 24 to 48 hours to form a relatively stable emulsion, similar to cow's cream in colour and consistency.

2. Effect of Solvent Concentration

Figure 2:
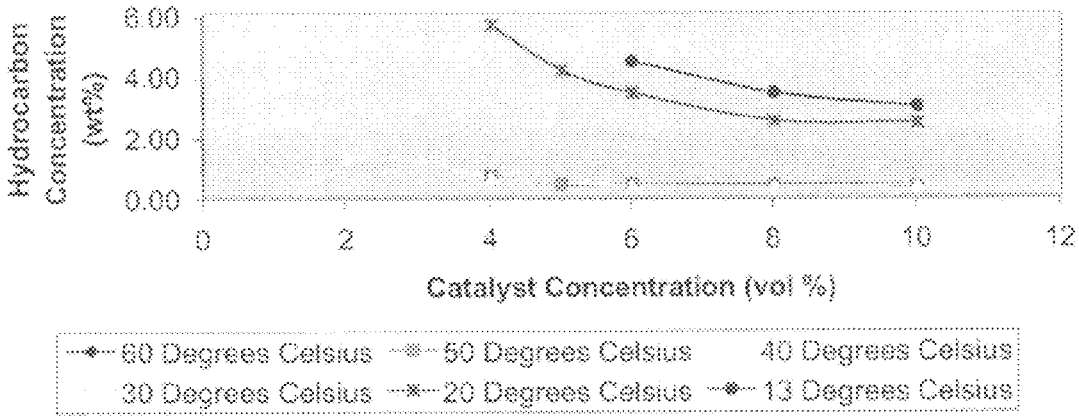
FIG. 2 is a graph showing residual hydrocarbon content in the sand.
Figure 12:
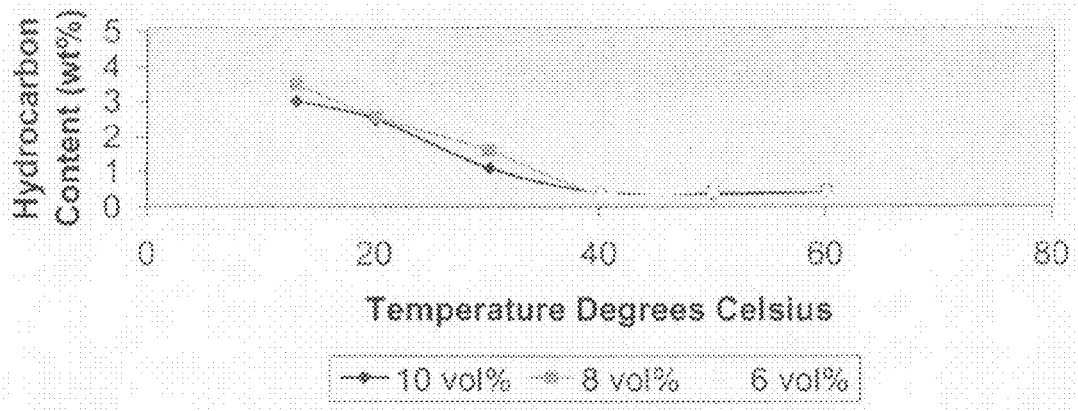
FIG. 12 is a graph showing residual hydrocarbon content in the sand.

Batch extraction runs were performed using oil sands from Utah to determine effectiveness of the cleaning emulsion in removing the hydrocarbons from the sand. Batch extraction runs at various temperatures and with various concentrations of the cleaning composition (40% d-limonene) were conducted and various data collected. The cleaning composition was added to a slurry of the oil sand in water, in approximately equal volume. The data indicated the following:

(a) As shown in FIGS. 2 and 12, there is little difference in the residual hydrocarbon content in the sand between 40 C and 60 C. The hydrocarbon content increases progressively below 40 C and at cleaning composition concentrations below 6%.

Figure 3:
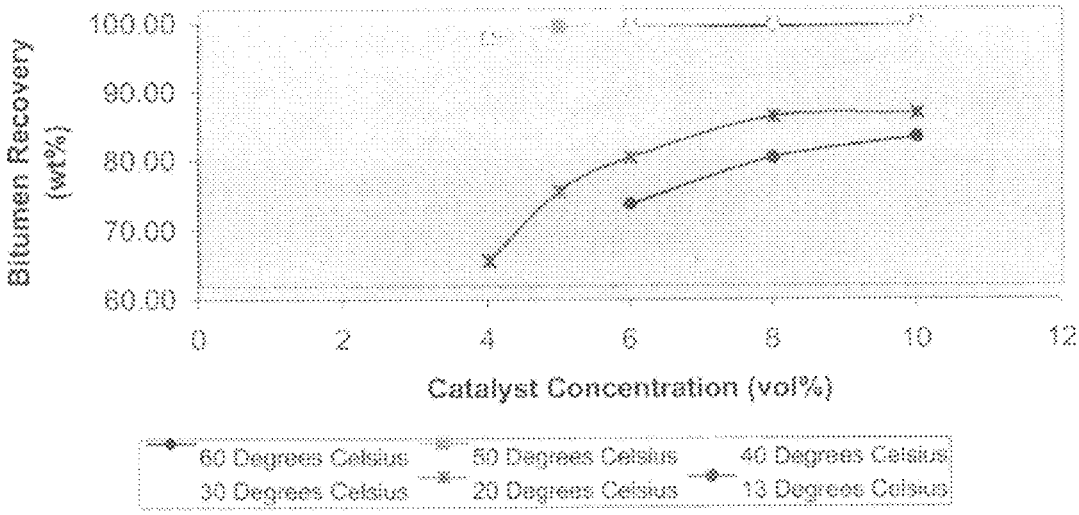
FIG. 3 is a graph showing bitumen recovery.
Figure 13:
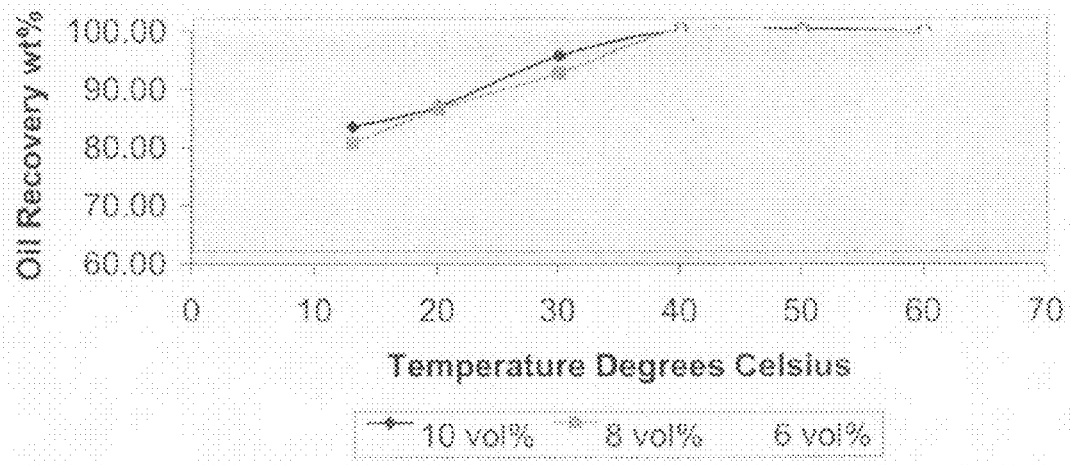
FIG. 13 is a graph showing bitumen recovery.

(b) As shown in FIGS. 3 and 13, there is little difference in bitumen recovery between 40 C and 60 C. Recovery does drop off at lower temperatures and at cleaning composition concentrations below 6%.

Figure 4:
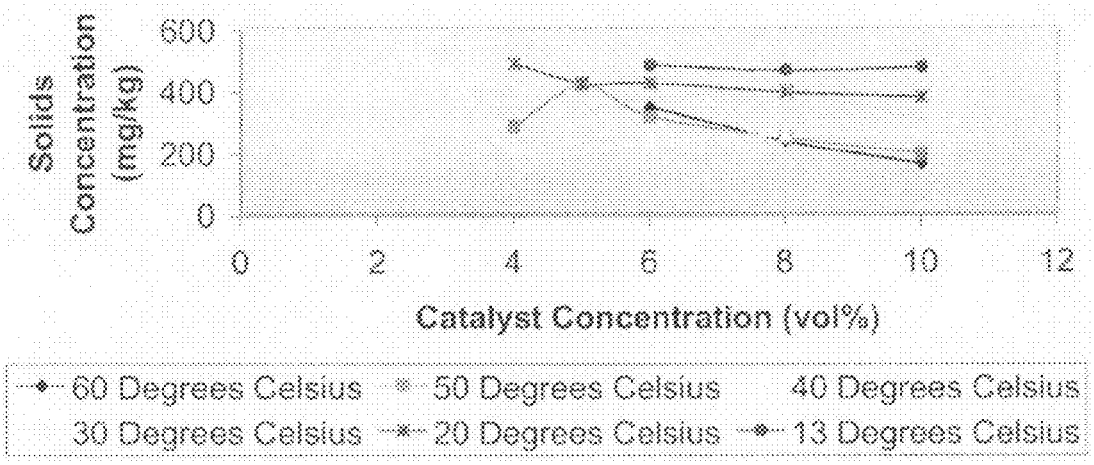
FIG. 4 is a graph showing solids in the water phase.
Figure 10:
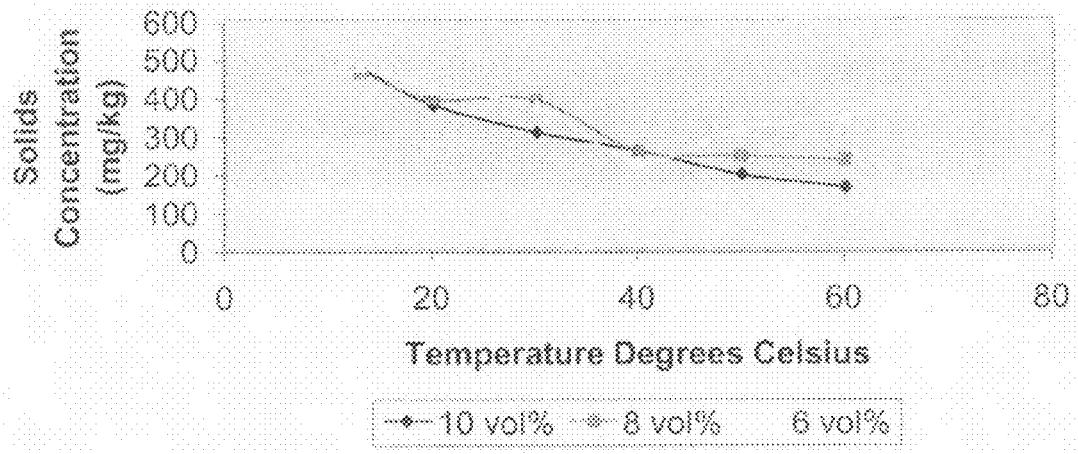
FIG. 10 is a graph showing solids in the water phase.

(c) As shown in FIGS. 4 and 10, solids in the water phase tend to decrease at temperatures greater than 40 C and with a decrease in cleaning composition concentration.

Figure 5:
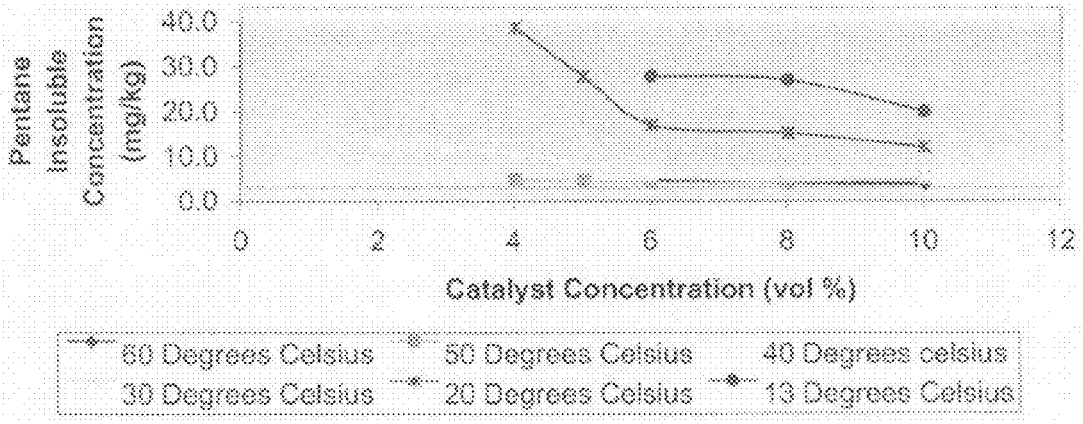
FIG. 5 is a graph showing pentane insolubles (asphaltenes) remaining in the water phase.
Figure 6:
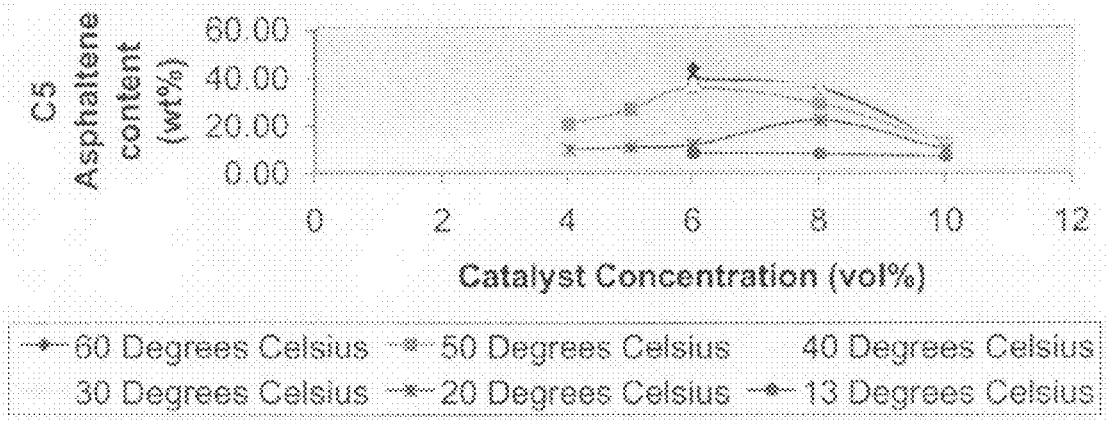
FIG. 6 is a graph showing asphaltenes in the residual hydrocarbon in the sand.
Figure 7:
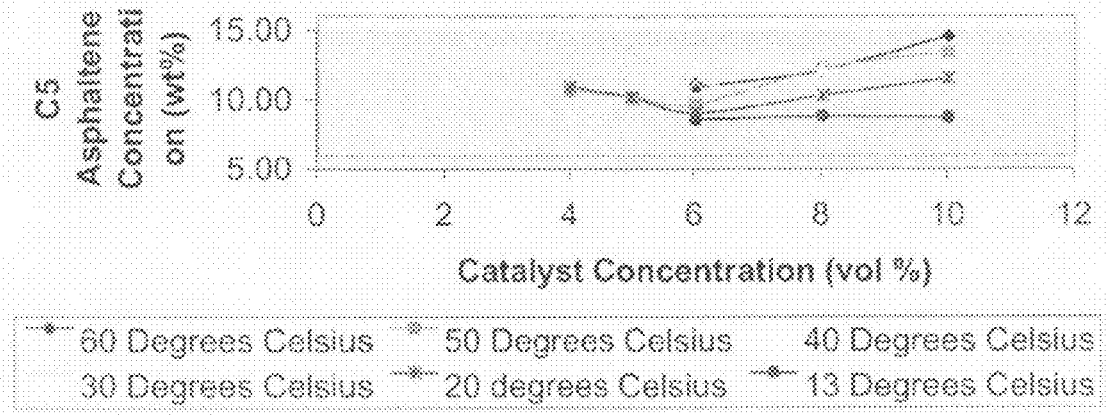
FIG. 7 is a graph showing asphaltene content in the produced oil.
Figure 8:
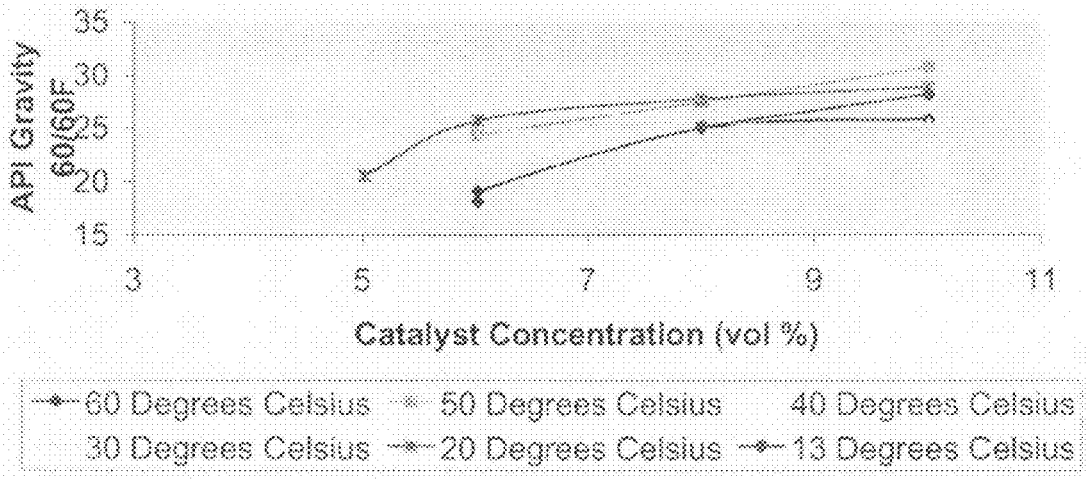
FIG. 8 is a graph showing API gravity of the recovered product at different concentrations of the cleaning emulsion.
Figure 9:
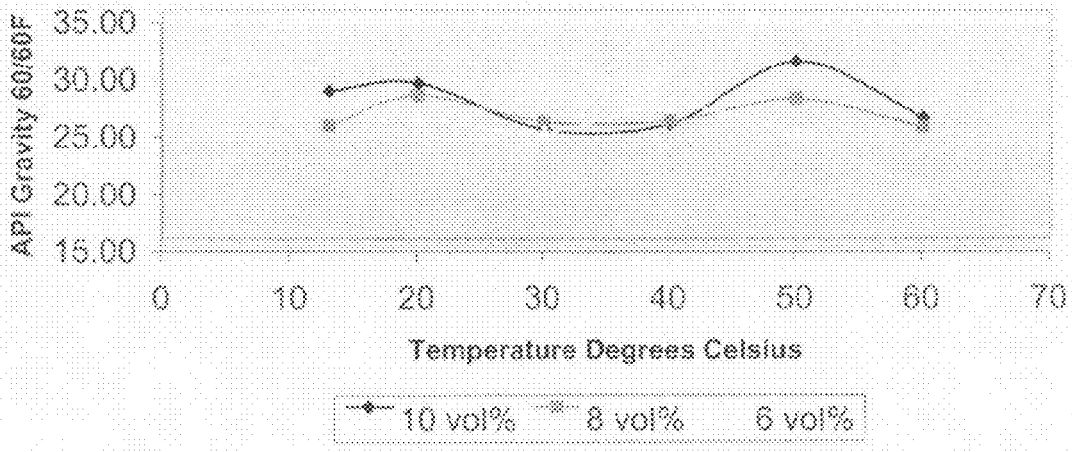
FIG. 9 is a graph showing API gravity of the recovered product at different temperatures.
Figure 11:
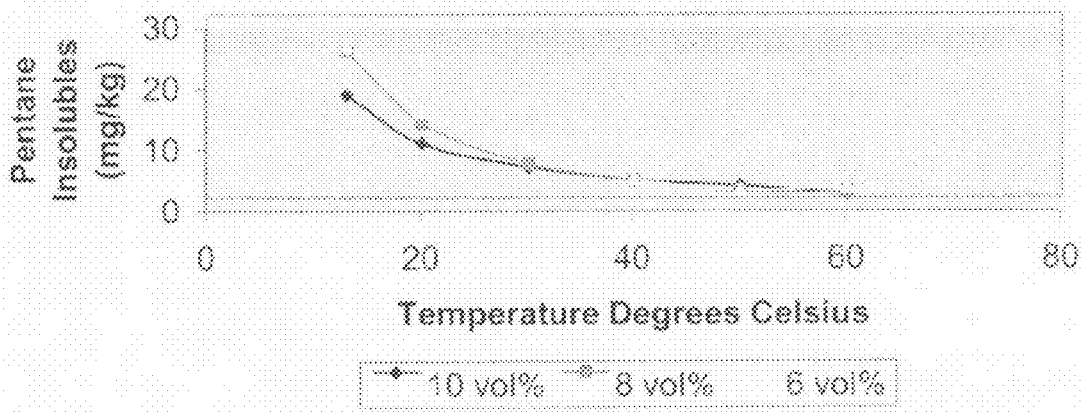
FIG. 11 is a graph showing pentane insolubles (asphaltenes) remaining in the water phase.
Figure 14:
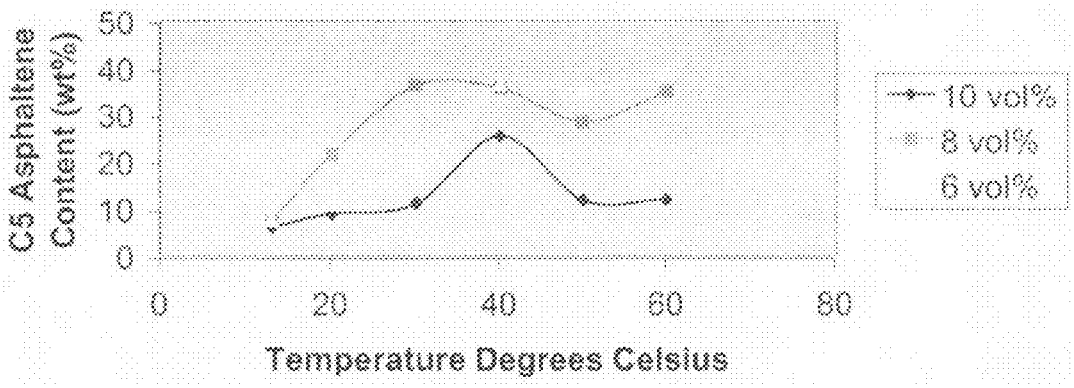
FIG. 14 is a graph showing asphaltene content in the residual hydrocarbon in the sand.
Figure 15:
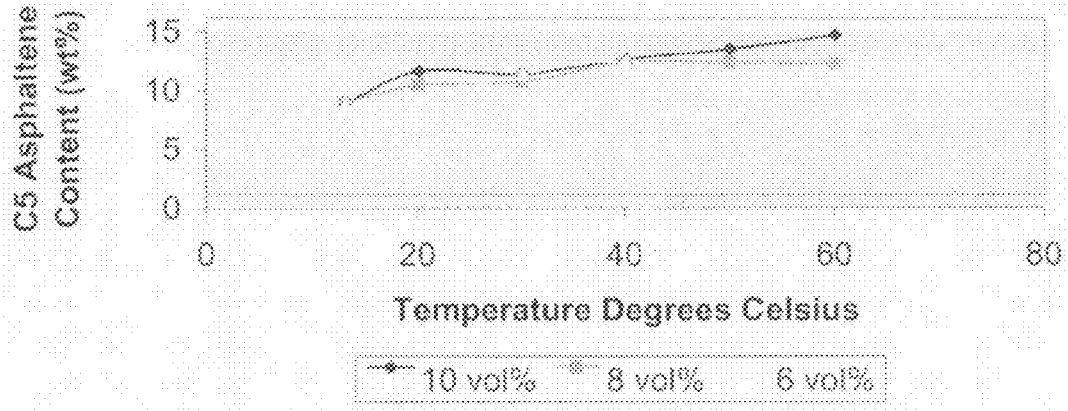
FIG. 15 is a graph showing asphaltene content in the produced oil.

(d) As shown in FIGS. 5 and 11, pentane insolubles (asphaltenes) in the water phase rises as the process temperature drops but shows little difference above 40 C;

(e) As shown in FIGS. 6 and 14, asphaltene in the hydrocarbon recovered from sand is highest at a cleaning composition concentration of 8% and increases with temperature;

(f) As shown in FIGS. 7 and 15, asphaltene in the produced oil tends to increase with increased temperature and at higher solvent concentrations; and (g) As shown in FIGS. 8 and 9, API product density increases with an increase in solvent concentration with no clear effect from varying temperatures.

The raw testing data is shown below in the following Tables. References to "catalyst" is a reference to the cleaning emulsion described herein.

TABLE #2

Batch Extraction Run @ 60° C.

| Catalyst Mix Vol % | pH Before Processing | pH After Processing | Product Density °API 60/60F | Water Phase (mg/kg) Solids | Water Phase (mg/kg) Pentane Insolubles | Oil in Sand (dry basis) Wt % | Oil Recovery (dry basis) Wt % | Asphaltene in Oil Recovered from Sand (dry basis) Wt % | Asphaltene in Produced Oil (dry basis) Wt % |
|---|---|---|---|---|---|---|---|---|---|
| 10 | 7 | 7 | 25.6 | 161 | 0.8 | 0.34 | 97.90 | 11.98 | 13.63 |
| 8 | 7 | 7 | 24.74 | 233 | 0.9 | 0.40 | 97.58 | 34.84 | 11.15 |
| 6 | 7 | 7 | 18.87* | 342 | 1.8 | 0.37 | 97.73 | 39.09 | 9.94 |
| 6 | 7 | 7 | 17.93* | 316 | 1.9 | 0.41 | 97.50 | 43.11 | 10.19 |

*Emulsion or froth in oil layer starting to form.

TABLE #3

Batch Extraction Run @ 50° C.

| Catalyst Mix Vol % | pH Before Processing | pH After Processing | Product Density °API 60/60F | Water Phase (mg/kg) Solids | Water Phase (mg/kg) Pentane Insolubles | Oil in Sand (dry basis) Wt % | Oil Recovery (dry basis) Wt % | Asphaltene in Oil Recovered from Sand (dry basis) Wt % | Asphaltene in Produced Oil (dry basis) Wt % |
|---|---|---|---|---|---|---|---|---|---|
| 10 | 7 | 7 | 30.51 | 193 | 2.0 | 0.29 | 98.22 | 11.76 | 12.43 |
| 8 | 7 | 7 | 27.21 | 242 | 1.1 | 0.35 | 97.86 | 28.40 | 11.27 |
| 6 | 7 | 7 | 24.19 | 313 | 1.3 | 0.38 | 97.65 | 35.11 | 8.69 |
| 5 | 7 | 7 | * | 416 | 1.5 | 0.41 | 97.52 | 25.95 | 9.21 |
| 4 | 7 | 7 | * | 281 | 1.8 | 0.67 | 95.90 | 19.63 | 9.65 |

*Heavy froth and emulsion in the oil layer, Unable to perform raw density.

TABLE #4

Batch Extraction Run @ 40° C.

| Catalyst Mix Vol % | pH Before Processing | pH After Processing | Product Density °API 60/60F | Water Phase (mg/kg) Solids | Water Phase (mg/kg) Pentane Insolubles | Oil in Sand (dry basis) Wt % | Oil Recovery (dry basis) Wt % | Asphaltene in Oil Recovered from Sand (dry basis) Wt % | Asphaltene in Produced Oil (dry basis) Wt % |
|---|---|---|---|---|---|---|---|---|---|
| 10 | 7 | 7 | 25.05 | 257 | 3.0 | 0.33 | 97.99 | 25.56 | 11.54 |
| 8 | 7 | 7 | 25.27 | 254 | 3.0 | 0.32 | 98.07 | 35.71 | 11.26 |
| 6 | 7 | 7 | 26.85 | 226 | 3.2 | 0.35 | 97.87 | 36.63 | 11.35 |
| 4 | 7 | 7 | 20 | 204 | 7.5 | 0.64 | 96.10 | 30.25 | 7.80 |
| 3 | 7 | 7 | * | 470 | 9.5 | 1.21 | 92.55 | 16.52 | 9.68 |
| 2 | 7 | 7 | * | 560 | 10.0 | 1.26 | 92.23 | 10.44 | 10.26 |

*Heavy froth and emulsion formed in the oil layer. Unable to perform raw density.

TABLE #5

Batch Extraction Run @ 30° C.

| Catalyst Mix Vol % | pH Before Processing | pH After Processing | Product Density °API 60/60F | Water Phase (mg/kg) Solids | Water Phase (mg/kg) Pentane Insolubles | Oil in Sand (dry basis) Wt % | Oil Recovery (dry basis) Wt % | Asphaltene in Oil Recovered from Sand (dry basis) Wt % | Asphaltene in Produced Oil (dry basis) Wt % |
|---|---|---|---|---|---|---|---|---|---|
| 10 | 7 | 7 | 24.56 | 305 | 5.0 | 1.03 | 93.64 | 11.11 | 10.26 |
| 8 | 7 | 7 | 25.19 | 390 | 5.6 | 1.52 | 90.62 | 36.31 | 9.62 |
| 6 | 7 | 7 | 24.32* | 374 | 8.9 | 1.93 | 88.03 | 19.36 | 10.28 |
| 5 | 7 | 7 | 20.60** | 327 | 14.4 | 2.68 | 82.28 | 13.56 | 12.44 |

*Heavy froth and emulsion formed in the oil layer.
**Emulsion or froth in oil layer starting to form.

TABLE #6

Batch Extraction Run @ 20° C.

| Catalyst Mix Vol % | pH Before Processing | pH After Processing | Product Density °API 60/60F | Water Phase (mg/kg) Solids | Water Phase (mg/kg) Pentane Insolubles | Oil in Sand (dry basis) Wt % | Oil Recovery (dry basis) Wt % | Asphaltene in Oil Recovered from Sand (dry basis) Wt % | Asphaltene in Produced Oil (dry basis) Wt % |
|---|---|---|---|---|---|---|---|---|---|
| 10 | 7 | 7 | 28.62 | 377 | 8.9 | 2.42 | 84.93 | 8.99 | 10.52 |
| 8 | 7 | 7 | 27.49 | 393 | 12.2 | 2.49 | 84.45 | 21.35 | 9.34 |
| 6 | 7 | 7 | 25.46* | 421 | 14.0 | 3.41 | 78.54 | 11.00 | 8.08 |
| 5 | 7 | 7 | 20.26* | 422 | 24.9 | 4.15 | 73.69 | 10.00 | 9.18 |
| 4 | 7 | 7 | * | 486 | 35.6 | 5.65 | 63.58 | 9.18 | 9.98 |

*Heavy froth and emulsion formed in the oil layer. Unable to perform raw density.

35

TABLE #7

Batch Extraction Run @ 13° C.

| Catalyst Mix Vol % | pH Before Processing | pH After Processing | Product Density °API 60/60F | Water Phase (mg/kg) Solids | Water Phase (mg/kg) Pentane Insolubles | Oil in Sand (dry basis) Wt % | Oil Recovery (dry basis) Wt % | Asphaltene in Oil Recovered from Sand (dry basis) Wt % | Asphaltene in Produced Oil (dry basis) Wt % |
|---|---|---|---|---|---|---|---|---|---|
| 10 | 7 | 7 | 27.82* | 474 | 16.8 | 2.95 | 81.50 | 6.13 | 7.74 |
| 8 | 7 | 7 | 24.88* | 463 | 23.9 | 3.41 | 78.53 | 7.32 | 7.84 |
| 6 | 7 | 7 | * | 479 | 24.8 | 4.43 | 71.80 | 7.57 | 7.55 |

*Heavy froth and emulsion formed in the oil layer. Unable to perform raw density.

TABLE #8

Batch Extraction Data for 10% Catalyst Concentration

| Catalyst Mix Vol % | pH Before Processing | pH After Processing | Product Density °API 60/60F | Water Phase (mg/kg) Solids | Water Phase (mg/kg) Pentane Insolubles | Oil in Sand (dry basis) Wt % | Oil Recovery (dry basis) Wt % | Asphaltene in Oil Recovered from Sand (dry basis) Wt % | Asphaltene in Produced Oil (dry basis) Wt % |
|---|---|---|---|---|---|---|---|---|---|
| 60 | 7 | 7 | 25.60 | 161 | 0.8 | 0.34 | 97.90 | 11.98 | 13.63 |
| 50 | 7 | 7 | 30.51 | 193 | 2.0 | 0.29 | 98.22 | 11.76 | 12.43 |

TABLE #8-continued

Batch Extraction Data for 10% Catalyst Concentration

| Catalyst Mix Vol % | pH Before Processing | pH After Processing | Product Density °API 60/60F | Water Phase (mg/kg) Solids | Water Phase (mg/kg) Pentane Insolubles | Oil in Sand (dry basis) Wt % | Oil Recovery (dry basis) Wt % | Asphaltene in Oil Recovered from Sand (dry basis) Wt % | Asphaltene in Produced Oil (dry basis) Wt % |
|---|---|---|---|---|---|---|---|---|---|
| 40 | 7 | 7 | 25.05 | 257 | 3.0 | 0.33 | 97.99 | 25.56 | 11.54 |
| 30 | 7 | 7 | 24.56 | 305 | 5.0 | 1.03 | 93.64 | 11.11 | 10.26 |
| 20 | 7 | 7 | 28.62 | 377 | 8.9 | 2.42 | 84.93 | 8.99 | 10.52 |
| 13 | 7 | 7 | 27.92 | 474 | 16.8 | 2.95 | 81.50 | 6.13 | 7.74 |

TABLE #9

Batch Extraction data for 8% Catalyst Concentration

| Catalyst Mix Vol % | pH Before Processing | pH After Processing | Product Density °API 60/60F | Water Phase (mg/kg) Solids | Water Phase (mg/kg) Pentane Insolubles | Oil in Sand (dry basis) Wt % | Oil Recovery (dry basis) Wt % | Asphaltene in Oil Recovered from Sand (dry basis) Wt % | Asphaltene in Produced Oil (dry basis) Wt % |
|---|---|---|---|---|---|---|---|---|---|
| 60 | 7 | 7 | 24.74 | 233 | 0.9 | 0.4 | 97.58 | 34.84 | 11.15 |
| 50 | 7 | 7 | 27.21 | 242 | 1.1 | 0.35 | 97.86 | 28.4 | 11.27 |
| 40 | 7 | 7 | 25.27 | 254 | 3 | 0.32 | 98.07 | 35.71 | 11.26 |
| 30 | 7 | 7 | 25.19 | 390 | 5.6 | 1.52 | 90.62 | 36.31 | 9.62 |
| 20 | 7 | 7 | 27.49 | 393 | 12.2 | 2.49 | 84.45 | 21.35 | 9.34 |
| 13 | 7 | 7 | 24.88 | 463 | 23.9 | 3.41 | 78.53 | 7.32 | 7.84 |

TABLE #10

Batch Extraction Data for 6% Catalyst Concentration

| Catalyst Mix Vol % | pH Before Processing | pH After Processing | Product Density °API 60/60F | Water Phase (mg/kg) Solids | Water Phase (mg/kg) Pentane Insolubles | Oil in Sand (dry basis) Wt % | Oil Recovery (dry basis) Wt % | Asphaltene in Oil Recovered from Sand (dry basis) Wt % | Asphaltene in Produced Oil (dry basis) Wt % |
|---|---|---|---|---|---|---|---|---|---|
| 60 | 7 | 7 | 18.87 | 342 | 1.8 | 0.37 | 97.73 | 39.09 | 9.94 |
| 50 | 7 | 7 | 24.19 | 313 | 1.3 | 0.38 | 97.65 | 35.11 | 8.69 |
| 40 | 7 | 7 | 26.65 | 226 | 3.2 | 0.35 | 97.87 | 36.63 | 11.35 |
| 30 | 7 | 7 | 24.32 | 374 | 8.9 | 1.93 | 88.03 | 19.36 | 10.28 |
| 20 | 7 | 7 | 25.46 | 421 | 14 | 3.41 | 78.54 | 11 | 8.08 |
| 13 | 7 | 7 | −7 | 479 | 24.8 | 4.43 | 71.8 | 7.57 | 7.55 |

As indicated in the tables, there was an incomplete separation of the phases after treatment at certain concentrations of the emulsion and at certain temperatures. Generally, these conditions are not suitable as it is preferred that the oil and water phases completely separate in the process.

In some cases, raw density of the recovered oil product was not able to be measured, as the oil product had frothed in the process. While excessive frothing is preferably avoided, it may be seen that some frothing did not affect oil recovery on a dry weight basis.

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

What is claimed is:

1. A process for primary extraction of bitumen from oil-wet or water-wet oil sands, comprising the step of forming a mixture by mixing an effective amount of a composition comprising an emulsion of an organic phase comprising d-limonene in an aqueous phase, with an aqueous slurry of the oil sands, and recovering a hydrocarbon phase, wherein the mixing step is conducted to avoid vigorous agitation to avoid forming stabilized suspensions of clay or other fine particles.

2. The process of claim 1 wherein the mixture comprises 4% or less d-limonene by volume, and the resulting hydrocarbon recovery exceeds 90% by weight.

3. The process of claim 2 which is conducted at a temperature of less than 80° C.

4. The process of claim 2 which is conducted at a temperature of 30° C. or higher.

5. The process of claim 1 wherein the organic phase of the composition is recovered from the extracted hydrocarbon phase, and recycled in the process.

6. The process of claim 1 wherein the mixing step is performed without significant froth formation.

7. The process of claim 1 further comprising the step of removing clay and other fine particles from an aqueous phase, and recycling the aqueous phase into the process.

8. The process of claim 1 wherein the oil sands comprises oil-wet oil sands.

9. The process of claim 1 wherein the oil sands comprises water-wet oil sands.

* * * * *